US008418385B2

(12) United States Patent
Olson

(10) Patent No.: US 8,418,385 B2
(45) Date of Patent: Apr. 16, 2013

(54) LIGHTING DEVICE

(76) Inventor: Michael Roger Olson, Waconia, MN (US)

( * ) Notice: Subject to any disclaimer, the term of this patent is extended or adjusted under 35 U.S.C. 154(b) by 366 days.

(21) Appl. No.: 12/876,205

(22) Filed: Sep. 6, 2010

(65) Prior Publication Data

US 2012/0055056 A1 Mar. 8, 2012

(51) Int. Cl.
*G09F 13/16* (2006.01)

(52) U.S. Cl.
USPC ..... 40/564; 40/576; 40/575

(58) Field of Classification Search ..... 40/575, 40/576, 546, 564; 362/297, 346
See application file for complete search history.

(56) References Cited

U.S. PATENT DOCUMENTS

| | | | | |
|---|---|---|---|---|
| 2,309,277 | A * | 1/1943 | Sams | 362/297 |
| 3,711,696 | A | 1/1973 | Sieloff | |
| 3,744,956 | A | 7/1973 | Hess | |
| 4,344,116 | A | 8/1982 | Martin | |
| 4,912,609 | A | 3/1990 | Gillette | |
| 4,929,866 | A * | 5/1990 | Murata et al. | 313/500 |
| 5,517,264 | A | 5/1996 | Sutton | |
| 5,540,719 | A | 7/1996 | Covelli-Ingwell et al. | |
| 5,622,424 | A | 4/1997 | Brady | |
| 5,733,035 | A | 3/1998 | Spenser et al. | |
| 5,887,802 | A | 3/1999 | Yousefzadeh | |
| 6,499,853 | B2 | 12/2002 | Stekelenburg | |
| 6,945,673 | B2 | 9/2005 | Yao | |
| 7,056,006 | B2 | 6/2006 | Smith | |
| 7,232,251 | B2 | 6/2007 | Chien | |
| 7,273,312 | B1 | 9/2007 | Birchler | |
| 7,455,444 | B2 | 11/2008 | Chien | |
| 2002/0074938 | A1 | 6/2002 | Gu | |
| 2005/0135107 | A1 | 6/2005 | Currie et al. | |
| 2005/0207145 | A1 | 9/2005 | Court | |
| 2005/0226006 | A1 | 10/2005 | Chen | |
| 2005/0259446 | A1 | 11/2005 | Smith et al. | |
| 2006/0062019 | A1 | 3/2006 | Young | |
| 2006/0072346 | A1 | 4/2006 | Chien | |
| 2006/0227574 | A1 | 10/2006 | Chien | |
| 2007/0076439 | A1 | 4/2007 | Chien | |
| 2007/0230175 | A1 | 10/2007 | Montgomery | |
| 2007/0242485 | A1 | 10/2007 | Chien | |
| 2008/0101058 | A1 | 5/2008 | Smith | |
| 2009/0019752 | A1 | 1/2009 | Liao | |
| 2009/0072970 | A1 | 3/2009 | Barton | |
| 2009/0073673 | A1 | 3/2009 | Young | |
| 2009/0175033 | A1 | 7/2009 | Chien | |
| 2009/0273927 | A1 | 11/2009 | Chien | |
| 2009/0284960 | A1 | 11/2009 | Chien | |

* cited by examiner

*Primary Examiner* — Casandra Davis
(74) *Attorney, Agent, or Firm* — Steven H Greenfield; Greenfield Invention and Patent Consulting, Inc.

(57) ABSTRACT

A lighting device configured for projecting a unique lighting to illuminate letters, figures and shapes displayed on the top of the device is disclosed. The letter and figures are interchangeable and maybe customized to individual tastes and interests. The lighting device comprises a chamber containing a light source and a plurality of reflector strips disposed in the inner portion of the chamber. The letters and figures are inserted into a longitudinal aperture at the top of the chamber and snapped onto a lip that protrudes from an aperture wall. An inclined reflector strip comprising of a plurality of flat portions and angled portions directs the light toward the bottom and sides of the letters and figures that permeates through the substantially transparent material the letters and figures comprise to produce the unique lighting effect. Alternatively, angled reflector tabs are used in lieu of the inclined reflector strip.

10 Claims, 7 Drawing Sheets

LIGHTING DEVICE

FIELD OF THE INVENTION

The present invention generally relates to a lighting device configured to display letters, figures and shapes that may be interchanged and customized to individual tastes and interests. The present invention also provides a unique lighting of the displayed letters and figures that balances visibility and opaqueness at night.

BACKGROUND OF THE INVENTION

A number of prior art references teach a variety of lighting devices illustrated in the examples below.

US Pre Grant publication number 20090284960A1 discloses an LED projection lighting device for night time or dark area use including plug-in wall outlet lighting device or direct current operated lighting device with projection features to project the image, message, data, logo, time on ceiling, walls, floor, desired surface. The said LED lighting device incorporated with optics means may selected from group combination from optics-lens, slides, openings, cut-outs, transparent material piece, translucent material piece, telescope assembly, housing-member, slide-film, slide-disc, elastic-member, tilt-means, rotating-means, adjust-means, roller-means, mechanic-means, extend-means, convex lens, concave lens, with precision optics calculation and optics design to make the said desire image, message, data, logo, time project to ceiling, walls, floor, or desired surface to be seen by viewer. The LED light has interchangeable power source arrangement for AC powered sealed-unit or DC powered battery-pack. US Pre Grant publication number 20090019752A1 is for a decorative lighting device comprising a supporting frame and a light arrangement. The supporting frame comprises a hollow supporting frame body for providing a replaceable decorative member thereon. The hollow supporting frame body has an inner surface and a continuously light channel indented on the inner surface and defines a peripheral inner wall inclinedly extended from the inner surface. The light arrangement comprise a light control circuit provided at the hollow supporting frame body, and a plurality of illuminators which are electrically connected to the light control circuit and spacedly and inclinedly aligned along the inner wall of the hollow supporting frame body. Each of the illuminators forms as a point of light source for mostly emitting light towards to the middle of the hollow supporting frame body so as to illuminating the decorative member. US Pre Grant publication number 20080101058A1 is for an item of furniture, especially a headboard of a bed, is personalized, e.g., with a user's name, and is backlit, thereby serving as a lighting device. US Pre Grant publication number US20090073673A1 refers to an artistic light box having a light transparent display panel, the entire display panel being covered by a single sheet; a side panel attaching to and extending outwardly from the display panel; and an illumination source positioned at the back surface of the display panel. The light box may be used as a nightlight, an illuminated piece of art, an illuminated craft product, or an illuminated learning tool. The light box may also be personalized by a user. US Pre Grant publication number 20070076439A1 teaches an LED lighting device with interchangeable display unit, which means that the display unit can be separated from the base by certain strength which can reduce the prong device been damaged by pulling, pushing, twisted because separated display unit will reduce the torque strength. The display unit may have the build-in input-end or the separated input-end to allow matching the said receptacle means of the base. The base with LED related circuit, prong means and other control device may disposed into the base or incorporated with sealed-unit to make the light beam to be seen by viewer though the display area for dedicated art, design, motion liquid, 3-dimensional colored image for illumination. U.S. Pat. No. 7,273,312 provides for a lighting device that has a hook for interchangeably receiving artistic stained glass ornaments to be displayed in front of a light source. The lighting device improves the aesthetic benefits of stained glass using lighting devices. U.S. Pat. No. 7,455,444 discloses a multiple light source lighting device incorporating at least two sets of light sources to offer perfect illumination for decorative lighting and also for providing area illumination via openings, windows, holes, cut-outs, and/or light-transmitting areas of the housing. The multiple light source sets may include LED or EL elements (including sheet, wire, or tube type elements), neon bulbs or tubes, or the like. In addition, the lighting device may incorporate an air freshener, fan, mechanical device, 03 generator, potpourri, deodorizer elements, fragrance elements, oil, chemical compounds, sensors, heat elements, and/or switch devices to provide additional functions when the prongs are connected with a power source. US20060227574A1 provides embodiments for a linear tube lighting device with changeable light patterns including a light source which selected from the group combination from LED, strobe light, neon light, gradation light, black light, LED inside tube, high voltage discharge light, arc light, fluorescent light, EL wires, EL twisted light, EL panels light, EL strips with changeable light patterns by automatically or manually control means to get the light patterns from one to others patterns which may selected from chasing, random, fade in and fade out, pair flashing, scan, flashing, steady on, gradation neon effects, lighted length changing, color changing, sequential flashing, any other combinations from convention market available functions. The linear tube lighting device with changeable patterns further incorporate with light sensor, sound sensor, timer to get the predetermined light effects, duration. US20060062019A1 discloses a portable rechargeable lighting device, which comprises a replaceable luminous decorative object, a lighting device with an electric accumulator for emergency lighting, a base including an embedding module; a control circuit including a transformer for providing an operating power supply and a charge power supply through an electrically connected device with different voltages and setting a plurality of operating modes by a programmable control unit, and users select the setting through the module switch; a light emitting component electrically connected to and controlled by said control circuit to emitting light from a light emitting device from an end surface of the base to a luminous decorative object; and a luminous decorative object embedded on the base, of which the light emitting mode can be changed to select different operations and sensing effects of the light. US20050226006A1 is for a lighting device assembly includes a light source, such as an electrical bulb and a cold light panel, and a decoration board removably attached to the light source. The decoration board includes a mount portion having a pair of resilient arms forming a clip for removably attaching the decoration board to the light source at any selected orientation and a receiving section including a resilient retention tab with a receiving slot defined therebetween to receive and retain a board portion therein. The board portion forms decoration patterns, which can be planar, raised or recessed. When the decoration board is attached to the light source by the clip, the board portion is positioned to allow light from the light source to transmit therethrough for projecting the decoration patterns to the space in any desired direction.

Generally, the present invention incorporates several unique features not found in the prior art references.

SUMMARY OF THE PRESENT INVENTION

In an aspect of the present invention, a lighting device containing a chamber having an inner portion and an outer portion, the chamber comprises: a front wall, a back wall, a first sidewall, a second sidewall, a top and a bottom; a light source disposed at a junction between the second side wall of the inner portion of the chamber and the bottom of the inner portion of the chamber; at least one reflector strip attached to an inner portion of the back wall; at least one reflector strip attached to an inner portion of the front wall an inclined reflector strip extending at a first end from a location at about a center of an inner portion of the first side wall to a location at about a center of the bottom of the chamber inner portion at a second end, the first end of the inclined reflector being attached to the first side wall of the chamber; and an aperture disposed longitudinally in the top of the chamber having a front wall and a back wall.

In another aspect of the present invention, a lighting device containing a chamber having an inner portion and an outer portion, the chamber comprises: a front wall, a back wall, a first sidewall, a second sidewall, a top and a bottom; a light source disposed at a junction between the second side wall of the inner portion of the chamber and the bottom of the inner portion of the chamber; at least one reflector strip attached to an inner portion of the back wall; at least one reflector strip attached to an inner portion of the front wall; a plurality of reflector tabs each having a top side and a bottom side, the bottom side of each reflector tab being attached to the bottom of the chamber, the reflector tabs extending from a location at about the first side wall to a location at about a center of the inner portion of the chamber, with each reflector tab being angled toward the first side wall; and an aperture disposed longitudinally in the top of the chamber having a front wall and a back wall.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention comprises a lighting device chamber configured to contain a plurality of interchangeable insignia that project a unique lighting effect, most pronounced at night or in dark surroundings, using a light source and reflectors positioned inside the chamber. The insignia may contain letters, figures, indicia and characters in a variety of shapes and sizes to suit one's individual taste, personality or interests. The outer portion of the chamber comprises a frame that may additionally feature ornamental designs to suit one's individual taste, personality or interests.

Figures 1, 1A:
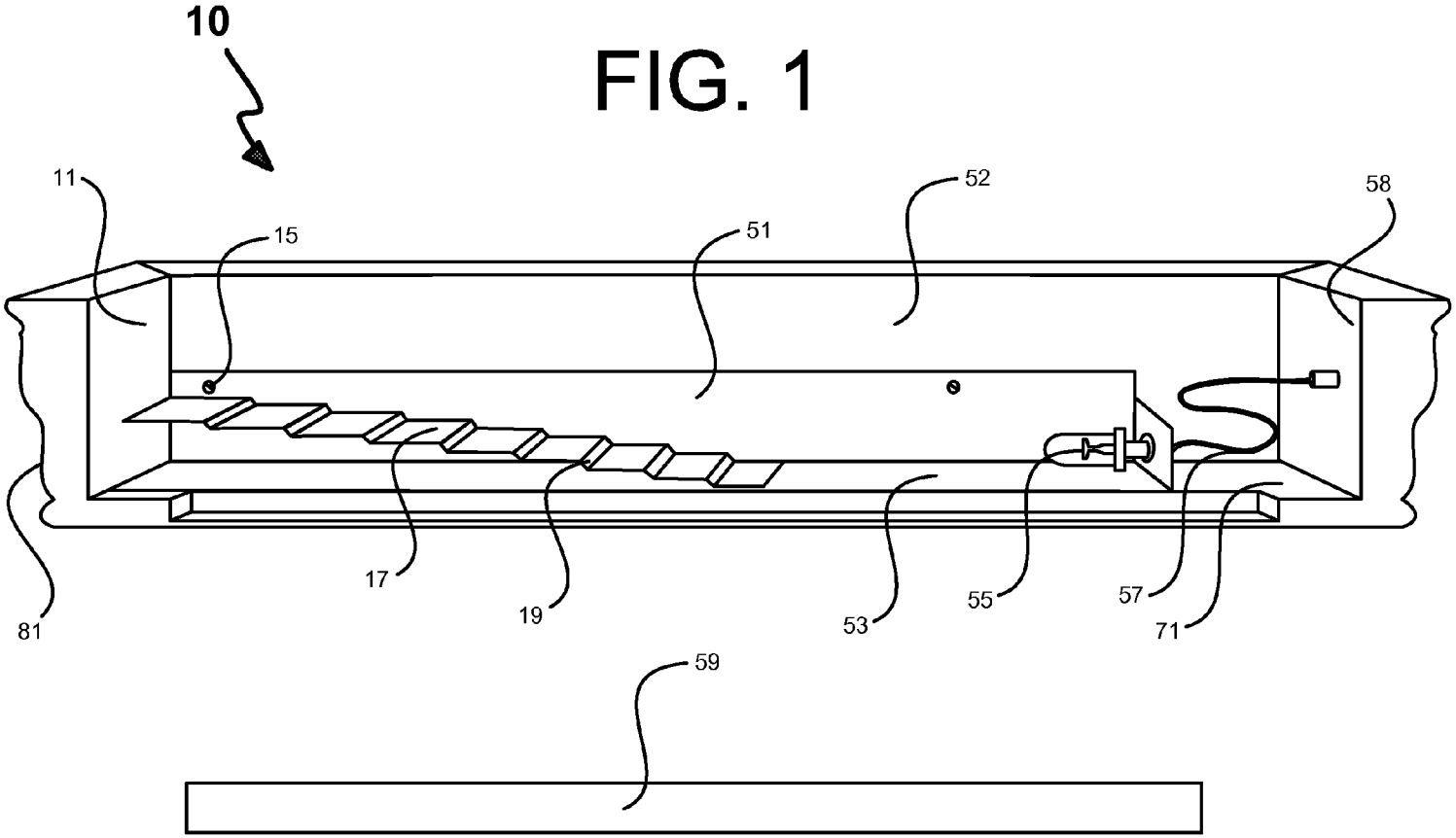
FIG. 1 is a cross sectional rear view of the lighting device chamber having an inclined reflector strip mounted onto the bottom and one side wall of the chamber interior according to an embodiment of the present invention.
FIG. 1A shows a reflector strip configured for mounting onto the bottom at the back wall of the chamber according to an embodiment of the present invention.

An embodiment of the present invention is illustrated in FIGS. 1-6. Shown in FIG. 1 are the first side wall 11, the second side wall 58 and the front wall 52 that define a portion of the inside of the lighting device chamber 10. Reflector strip 51 is placed on the lower inside potion of the front wall 52 by screws 15 and strip 53 is placed on the bottom 71 of the chamber 10. An inclined reflector strip is shown extending at one end from about the center of an inner portion of the first side wall 11 to about the center of the bottom of the chamber 71 at the second end. The inclined reflector comprises flat portions 17 and angled portions 19. In this embodiment, the flat portions 17 are substantially parallel with the bottom of the chamber 71 and the angled portions 19 have about a 45 degree slope relative to the bottom of the chamber 71. An end flat portion 17 of the inclined reflector strip is positioned on about the middle of the bottom strip 53 while the flat portion 17 on the other end is attached onto the first side wall 11. The attachment may be accomplished by placing the edge of this end into a groove carved in the side wall 11. The inclined reflector strip reflects the light from light source 55 placed at the opposite side from the inclined reflector strip inside the chamber and directs it toward the bottom and sides of insignia placed at the top of the lighting device chamber. The inclined reflector strip may contain nine alternating flat portions 17 and eight angled portions 19; however, more or fewer than nine flat portions 17 and more than eight angled potions 19 may be used depending on the size of the lighting device.

Figure 1B:
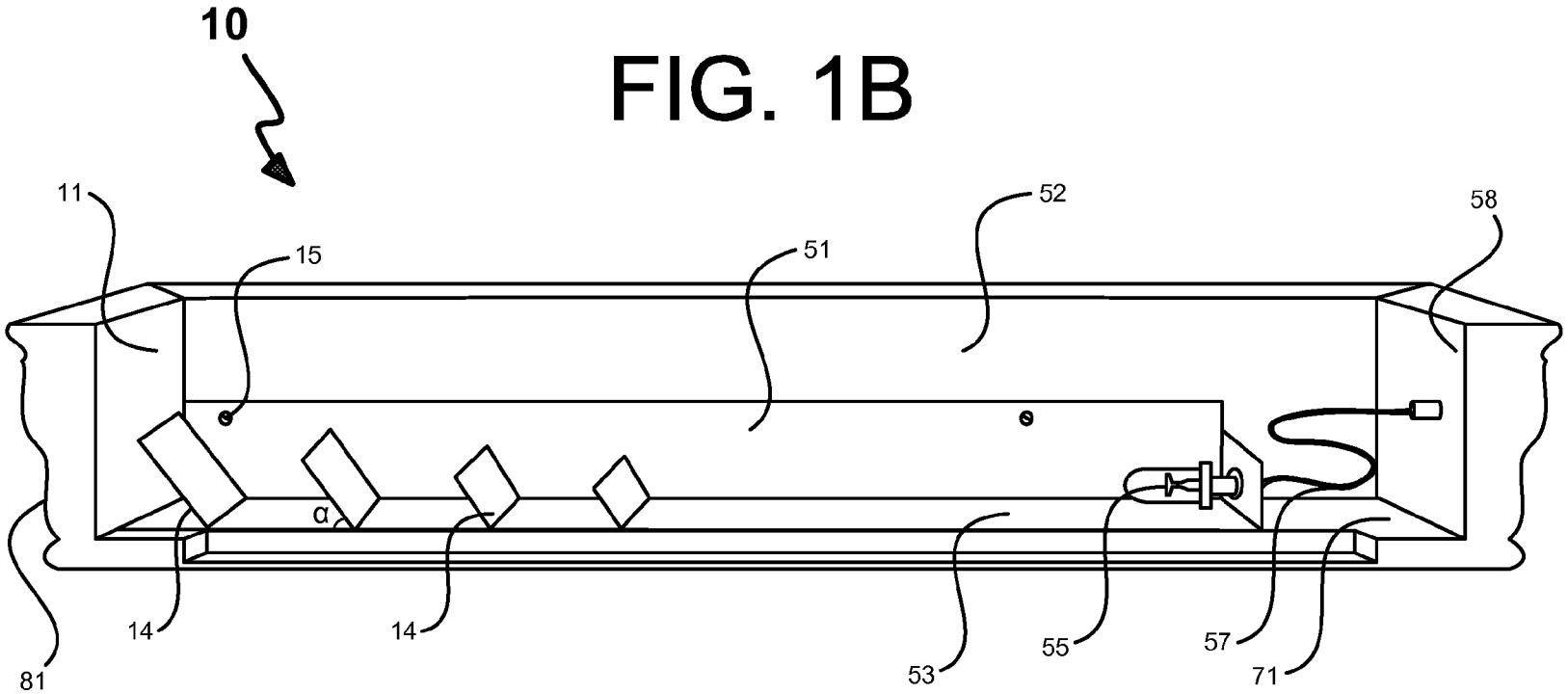
FIG. 1B is a cross sectional rear view of the lighting device chamber having reflector tabs mounted onto the bottom of the chamber interior according to an embodiment of the present invention.

In another embodiment, reflector tabs 14 are used instead of the inclined strip as shown in FIG. 1B. The tabs 14 are positioned on the bottom strip 53 and are angled toward the first side wall 11. The preferred angle, $\alpha$, is about 45 degrees relative to the bottom 71 but may range from about 25 to about 65 degrees. In the preferred embodiment, four tabs 14 are used and the sizes of the tabs 14 decreases going from the first side of the chamber 11 to the center.

Figure 2:
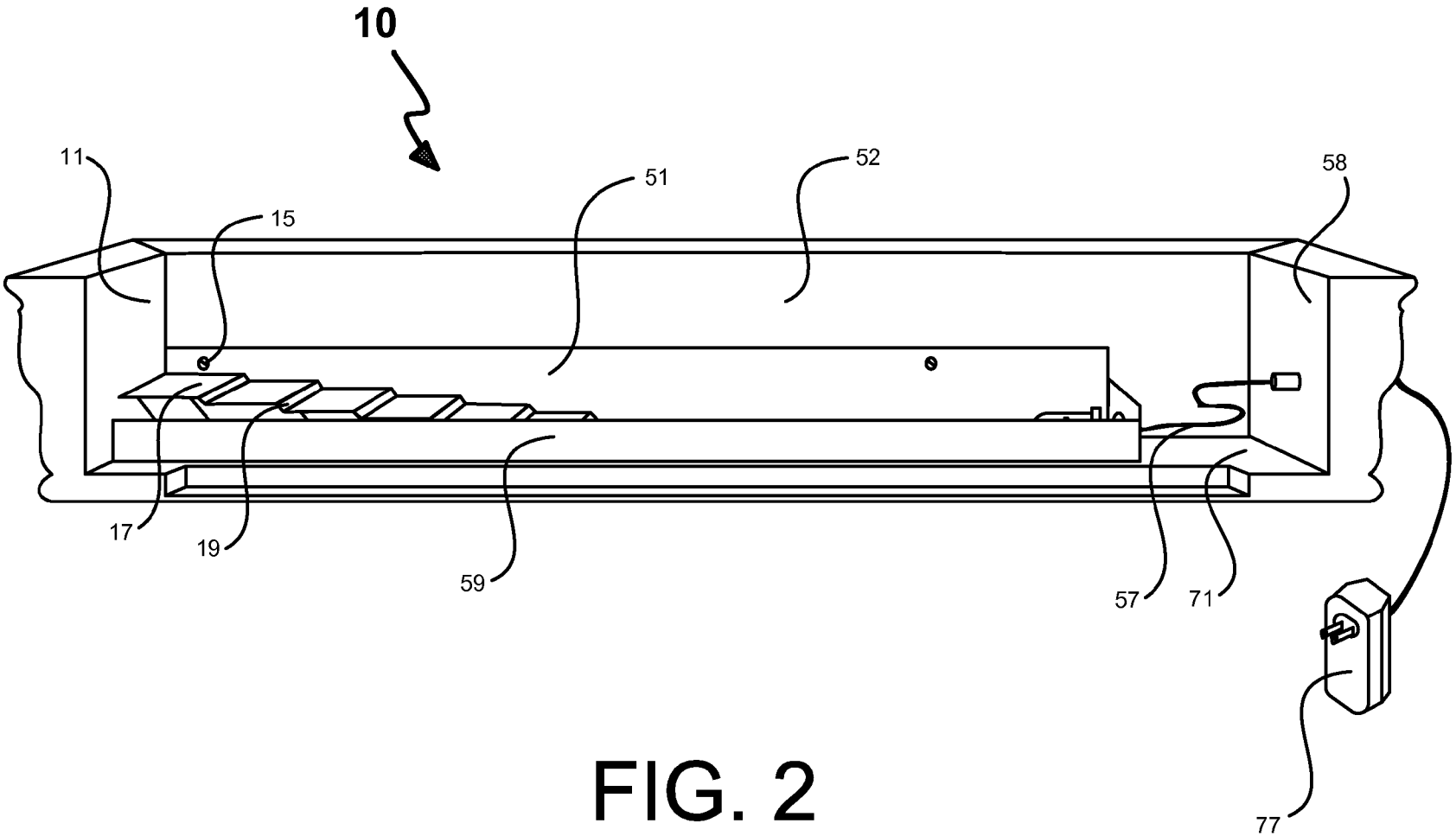
FIG. 2 is a cross sectional rear view of the lighting device chamber of FIG. 1 showing the reflector strip of FIG. 1A mounted onto the bottom of the chamber at the back wall according to an embodiment of the present invention.
Figure 2A:
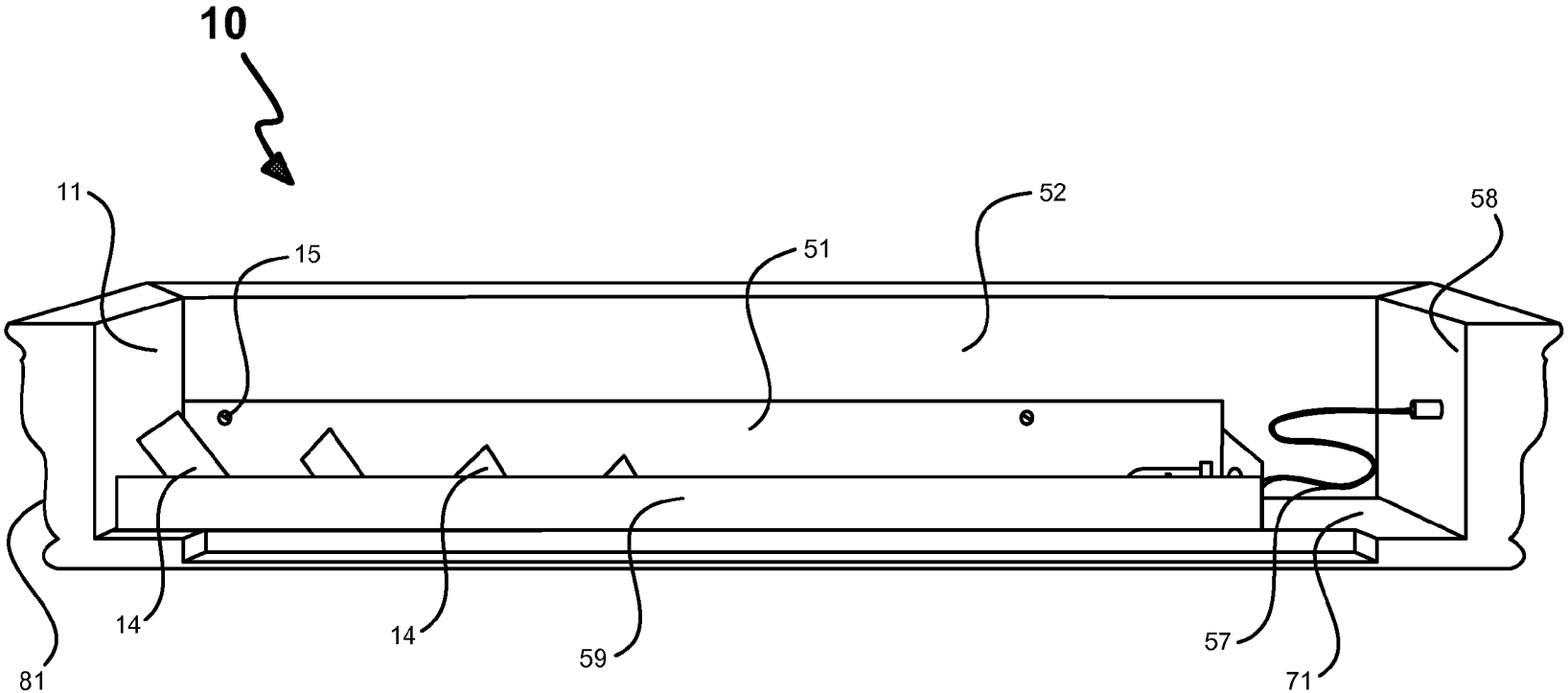
FIG. 2A is a cross sectional rear view of the lighting device chamber of FIG. 1B showing the reflector strip of FIG. 1A mounted onto the bottom of the chamber at the back wall according to an embodiment of the present invention.
Figure 3:
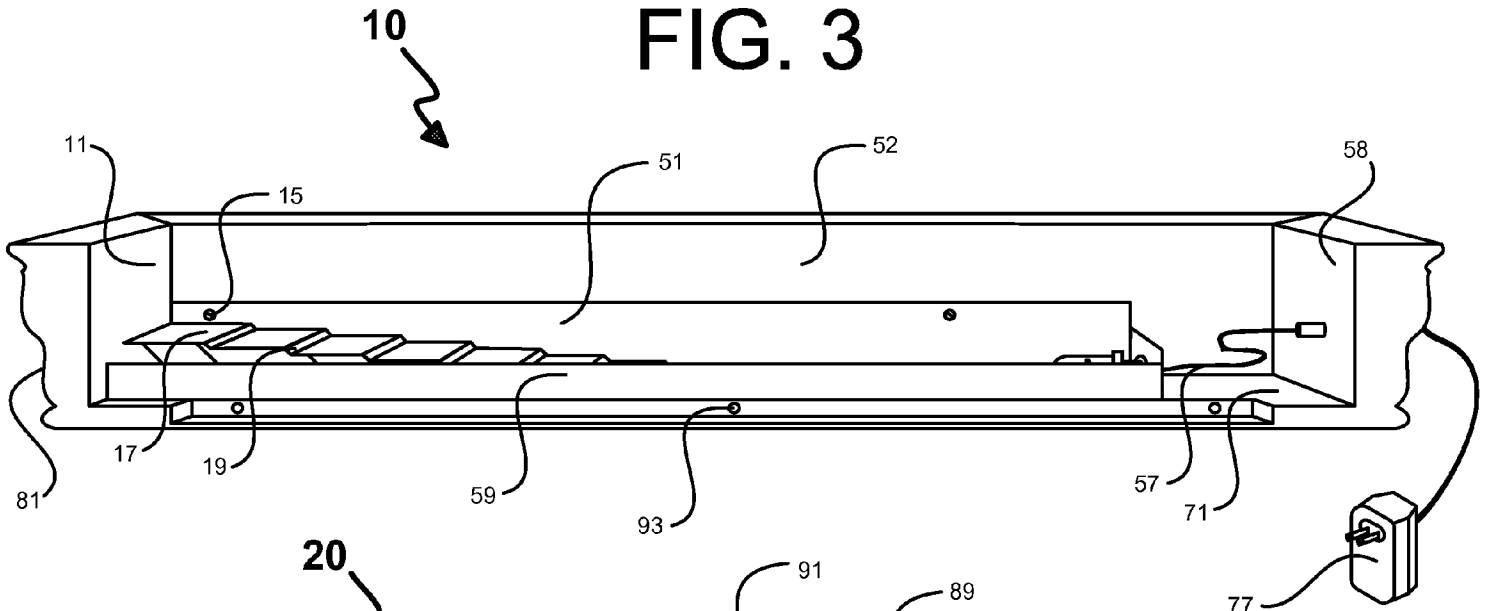
FIG. 3 is a cross sectional rear view of the lighting device chamber of FIG. 2 shown next to the inner portion of the rear and top side shown in FIG. 3A configured to be mounted on the back and top of the lighting device chamber according to an embodiment of the present invention.
Figure 3A:
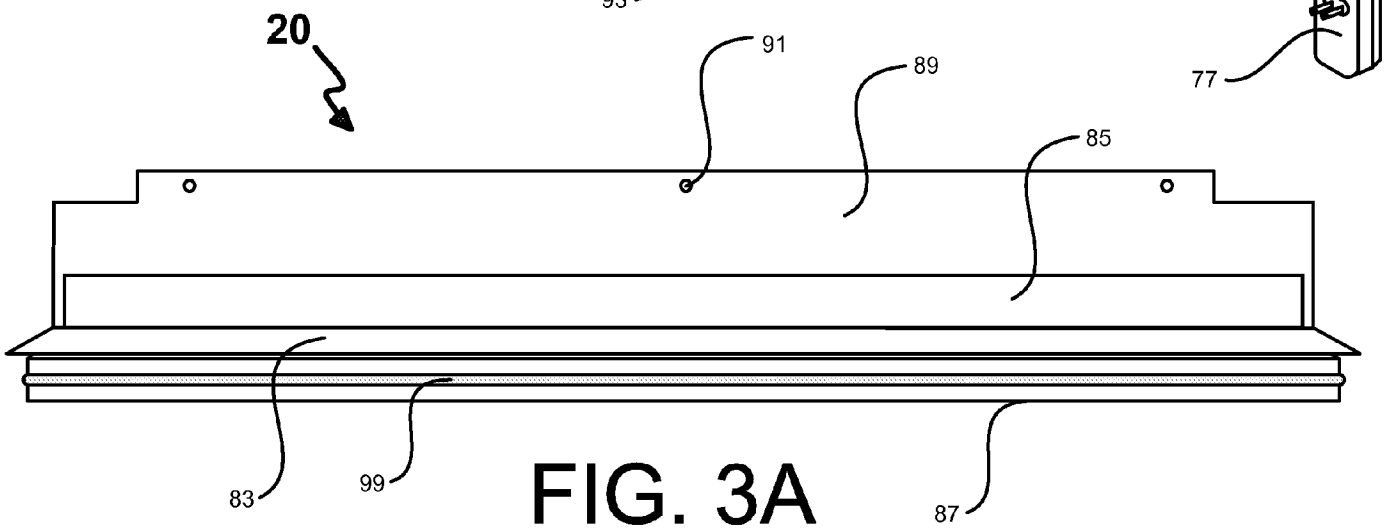
FIG. 3A shows the inner portion of the rear and top side configured to be mounted on the back and top of the lighting device chamber according to an embodiment of the present invention.

A strip 59 shown in FIG. 1A is mounted to the bottom 71 near the back wall in substantially parallel position to the front wall strip 51 as shown in FIG. 2. A light source 55 connects through a power source using power cord 57. A wall connector 77 may be used as the voltage source; however, a battery power source also falls within the scope of the present invention. The back wall 89 and a portion of the top of the chamber 20 are shown in FIG. 3A alongside the assembled front and sides of the chamber 10 shown in FIG. 3. The assembly 20 of back wall 89 and a portion of the top of the chamber 87 comprises back wall 89, reflector strip 85 attached to the back wall 89 and a strip 83 that serves as a dust shield protrudes from the back wall in a substantially straight angle in relation to the back wall 89. Also shown is a portion of the top of the chamber 87 attached to the back wall 89. The assembly of the back wall and a portion of the top of the chamber 20 is configured for attachment to the assembled front and sides of the chamber 10 by screws inserted through holes 91 in the back wall 89 and holes 93 in the bottom 71 of the chamber 10.

Figures 4, 5:
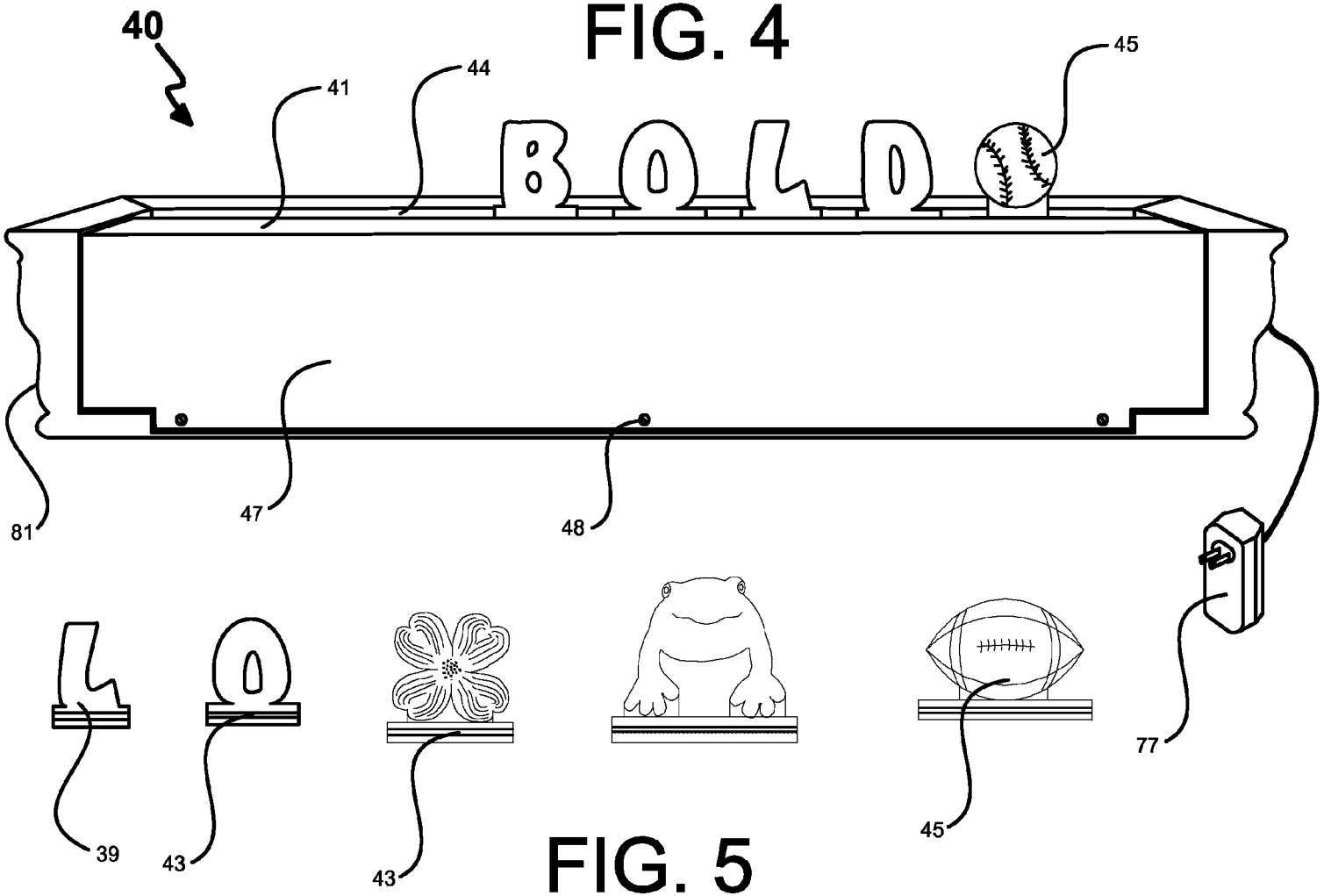
FIG. 4 is a top rear perspective view of the assembled lighting device chamber shown with insignia at the top of the lighting device chamber according to an embodiment of the present invention.
FIG. 5 shows letter and figure insignias for use with the lighting device according to an embodiment of the present invention.

The fully assembled lighting device chamber 40 is shown in FIG. 4 featuring the outer back wall 47 and top wall member 41 attached to the front and sides of the chamber by screws 48. The assembly of the chamber 40 forms an aperture 44 that runs substantially through the length of the chamber 40 and defines a longitudinal aperture front wall and a longitudinal aperture back wall. A lip 99 protrudes from the aperture back wall 44 as shown in FIG. 3A. The lip 99 is used for fastening the insignia placed at the top of the lighting device chamber.

Figure 6:
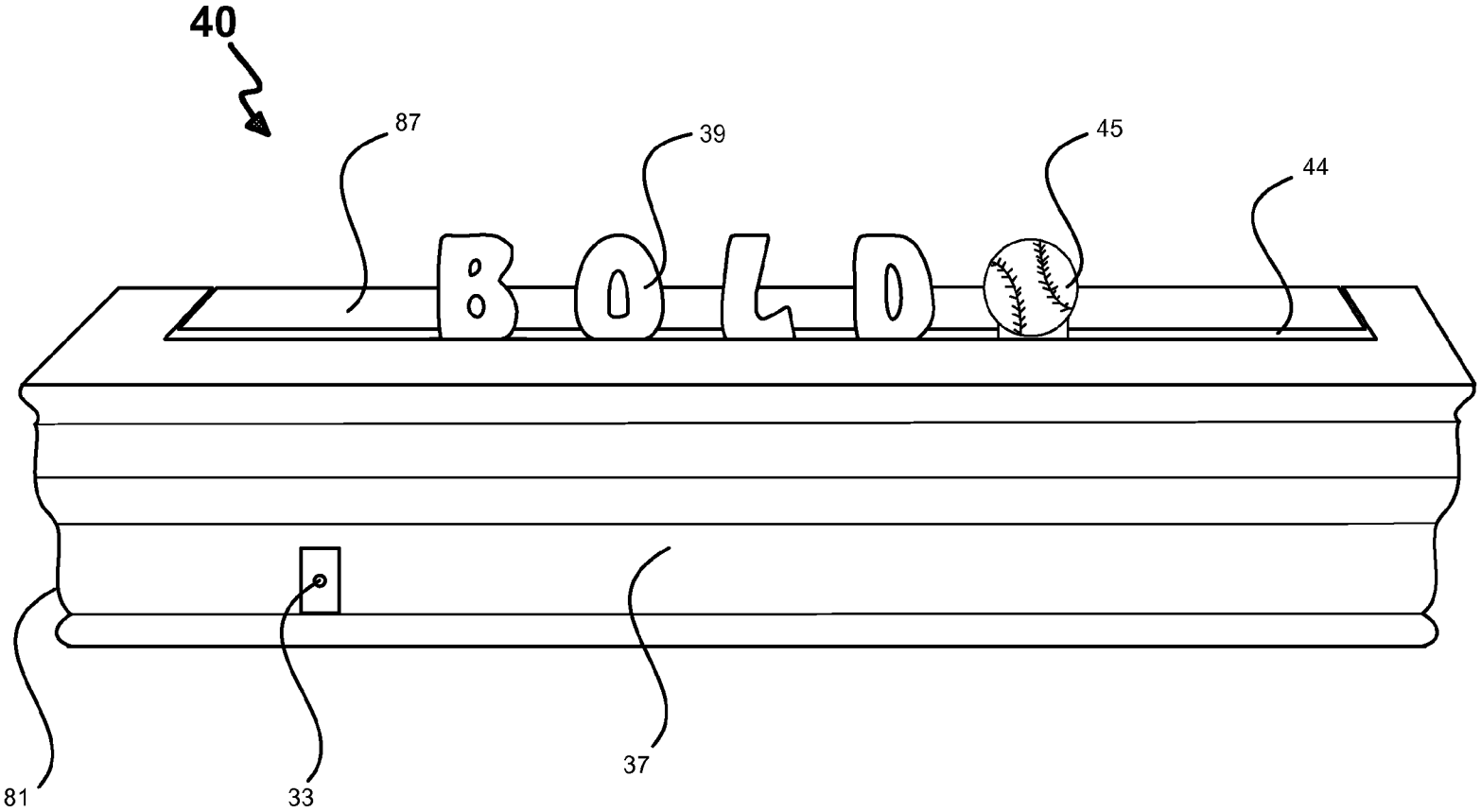
FIG. 6 is a top front perspective view of the lighting device shown with insignia at the top of the lighting device chamber according to an embodiment of the present invention.

The outer sidewalls 81 are shown to have an ornamental design. FIG. 5 shows insignia comprising letters 39 and FIG. 45, each having a base containing a longitudinal groove 43. The insignia are inserted through aperture 44 in a manner that the groove 43 of each letter 39 or FIG. 45 snaps onto the lip 99. As a result, the insignia are positioned onto the top of the lighting device. FIG. 6 shows the outer front side 37 of the lighting device 40. The dust shield 83 shown in FIG. 3A prevents dust from falling through the aperture 44 into the chamber as well as any insignia that may fall through the aperture in the process of mounting them onto the lip 99. It is preferably made of clear and transparent plastic such as Plexiglass so that the dust shield does not distort the light reflected through the aperture 44 to illuminate the insignia. An on-and-off switch 33 is disposed on the outer front side 37.

The insignia preferably comprise transparent bubble acrylic material having a thickness of about 0.22 inches and have an integral base height of about 0.5 inches. Their length varies depending on type of insignia and their shape. A portion of the light from the light source 55 is redirected by the reflectors through the aperture 44 and dust shield 83 to illuminate the insignia from the bottom and sides. The light penetrates the generally transparent bubble acrylic material and creates a unique diffuse lighting that makes the insignia visible at night. Polishing the bottoms of the insignia may further enhance the penetration of the light through these insignia. The preferred light source for illuminating the insignia is a white or colored LED; however incandescent lights, neon lights, fluorescent lights and strobe lights also fall within the scope of the present invention. Turning the lighting device and off may be accomplished by any switch means including mechanical, electrical, manual and automatic.

The chamber frame may be made of any suitable material of construction including but not limited to wood, metal, plastic or a combination thereof. The reflector strips may be made of tin or aluminum sheets plated with a chrome finish that provide a highly reflective surface.

It should be understood, of course, that the foregoing relates to exemplary embodiments of the invention and that modifications may be made without departing from the spirit and scope of the invention.

I claim:

1. A lighting device containing a chamber having an inner portion and an outer portion, said chamber comprising:

a front wall, a back wall, a first sidewall, a second sidewall, a top and a bottom;

a light source disposed at a junction between the second side wall of the inner portion of the chamber and the bottom of the inner portion of the chamber;

at least one reflector strip attached to an inner portion of the back wall;

at least one reflector strip attached to an inner portion of the front wall;

an inclined reflector strip extending at a first end from a location at about a center of an inner portion of the first side wall to a location at about a center of the bottom of the chamber inner portion at a second end, said first end of the inclined reflector being attached to the first side wall of the chamber; and an aperture disposed longitudinally in the top of the chamber having a front wall and a back wall.

2. The lighting device of claim 1, wherein the inclined reflector strip comprises a plurality of flat portions and a plurality of angled portions wherein each angled portion is disposed between two flat portions, said flat portions being substantially parallel in relation to the bottom of the chamber, said angled portions being angled at about 45 degrees in relation to the bottom of the chamber.

3. The lighting device of claim 1, further comprising a reflector strip mounted on the bottom of the inner portion of the chamber and a reflector strip attached to the inner portion of the chamber back wall.

4. The lighting device of claim 3, wherein the reflector strips comprise a chrome surface finish.

5. The lighting device of claim 3 further comprising a longitudinal strip protruding from the back wall of the chamber in a substantially straight angle relative to said back wall in a manner that said strip substantially overlays the aperture in the inner portion of the chamber.

6. The lighting device of claim 1, further comprising a longitudinal lip protruding from the back wall of the aperture.

7. The lighting device of claim 6 further comprising insignia adapted to mount onto the longitudinal lip attached to the inner portion of the back wall, said insignia protruding out from the inner portion of the chamber to the outer portion of the chamber, said insignia being adapted for projecting light emanating from the inner portion of the chamber to outer chamber surroundings.

8. The lighting device of claim 7, wherein the insignia comprises at least one letter, said letter having a base, said base containing a groove adapted to fasten onto the longitudinal lip.

9. The lighting device of claim 7, wherein the insignia comprises at least one figure, said figure having a base, said base containing a groove adapted to fasten onto the longitudinal lip.

10. The lighting device of claim 7, wherein a material of construction of the insignia comprises bubble acrylic.

* * * * *